US005102201A

United States Patent [19]

Akesaka et al.

[11] Patent Number: 5,102,201

[45] Date of Patent: Apr. 7, 1992

[54] SHIELD TUNNELLING MACHINE

[75] Inventors: Toshio Akesaka, Yokohama; Makoto Kajiyama, Ichikawa, both of Japan

[73] Assignee: Kabushiki Kaisha Iseki Kaihatsu Koki, Tokyo, Japan

[21] Appl. No.: 622,413

[22] Filed: Dec. 3, 1990

[30] Foreign Application Priority Data

Dec. 5, 1989 [JP] Japan ..... 1-314166

[51] Int. Cl.[5] ..... E21D 9/08

[52] U.S. Cl. ..... 299/85; 299/32; 299/80; 405/141; 405/138

[58] Field of Search ..... 405/144, 141, 138, 146; 299/80, 85, 33, 31

[56] References Cited

U.S. PATENT DOCUMENTS

| | | | |
|---|---|---|---|
| 2,389,920 | 11/1945 | Mavor | 299/80 X |
| 2,789,806 | 4/1957 | Buttrick | 299/80 X |
| 3,285,665 | 11/1966 | Brown | 299/80 |
| 4,311,344 | 1/1982 | Akesaka | 405/144 X |
| 4,555,143 | 11/1985 | Wrulich et al. | 299/85 X |
| 4,630,869 | 12/1986 | Akesaka et al. | 299/33 |

*Primary Examiner*—Dennis L. Taylor

*Attorney, Agent, or Firm*—Stoel Rives Boley Jones & Grey

[57] ABSTRACT

A shield tunnelling machine is provided that includes a cylindrical shield body; a rotary cutter head disposed on a front end of the shield body and provided with a face plate having one or a plurality of slits extending in the radial direction; and intermediate support member for supporting a plurality of cutter bits respectively having forward bit portions and backward bit portions in each of the slits; a support structure for supporting the intermediate support member swingably around an axis extending in the radial direction; a member for movably guiding the support structure in the axial direction of the shield body; and a cylinder device and a piston for moving the support stucture in the axial direction of the shield body to move the cutter bits toward and away from the front face of the face plate, the face plate and the guide member sharing the excavation force exerted against the cutter bits.

9 Claims, 3 Drawing Sheets

SHIELD TUNNELLING MACHINE

FIELD OF THE INVENTION

This invention relates to a shield tunnelling machine and, more particularly, to a shield tunnelling machine provided with a rotary cutter head.

BACKGROUND OF THE INVENTION

In a tunnelling machine having a rotary cutter head disposed on a front end of a cylindrical shield body, the rotary cutter head is provided with a face plate having one or a plurality of slits extending in the radial direction and a plurality of cutter bits disposed in the respective slits such that portions of the cutter bits extend from the slits. The rotary cutter head is rotated while the shield body is advanced to excavate natural ground with the cutter bits.

The length of each cutter bit projecting from the front face of the face plate is varied in accordance with the hardness of the natural ground to be excavated. When the natural ground is soft, it is preferable to make the projecting length of each cutter bit long to improve the operability of the tunnelling machine. On the other hand, when the natural ground is hard, the projected length is generally made shorter to ensure excavation by a predetermined energy input or applied force. Consequently, a tunnelling machine has been proposed in which the cutter bits are formed to be movable toward and away from the front face of the face plate (see Japanese Patent Publication (KOKOKU) No. 62-24597).

Such cutter bits respectively provided with forward bit portions and backward bit portions experience severe wear on their backward bit portions in the forward rotation and severe wear on their forward bit portions in the backward rotation. Accordingly, a rotary cutter head, having cutter bits mounted on the face plate swingably around an axis extending in the radial direction, has been proposed to reduce this wear (see Japanese Patent Publication (KOKOKU) No. 62-317).

Whenever the natural ground is composed of a very hard viscous soil layer or a mud stone layer, the natural ground may not be excavated by a forward and backward moving cutter head. The bit portions of cutter bits serving to excavate the natural ground, as well as bit portions of the cutter bits not serving to excavate the natural ground, should intrude into the natural ground while the cutter head is rotated in simple contact with the natural ground even if the cutter bits are pressed against the hard self-supporting natural ground as noted above and a turning force is given to the cutter head. Whenever the bit portions are forced to intrude into the natural ground, an extremely large thrust is needed, and the strength or hardness of each cutter bit should be increased.

When a rotary cutter head having swingable cutter bits is used, only bit portions serving for excavation are able to intrude into the natural ground.

However, since each cutter bit as described in the above-mentioned Japanese Patent Publication (KOKOKU) No. 62-317 is fixed to a bit seat swinging around a pivot pin supported on the face plate, the cutter bits are unable to move toward and away from the front face of the face plate. Thus, the length of each cutter bit projecting from the front face of the face plate is constant, and the tunnelling machine must in this condition cope with the excavation of either hard or soft natural ground. If the projecting length of each cutter bit is adjusted for excavation of hard natural ground, while attaching importance to safety, the efficiency during excavation of soft natural ground is decreased. On the other hand, if the projecting length of each cutter bit is adjusted for excavation of soft natural ground, while attaching importance to the efficiency of operation, the hard natural ground may not be excavated.

Furthermore, the force created during the excavation operation and exerted upon the cutter bits of the swingable type as noted above is received by the pivot pin, the bit seat, and the contact surface of the bit seat with the face plate. Thus, when particularly hard natural ground is excavated, a large bending moment is exerted to the pivot pin and may result in a defective swing of the cutter bits due to the bending of the pivot pin, thereby causing shear on the pivot pin.

SUMMARY OF THE INVENTION

An object of the present invention is to provide a shield tunnelling machine having swingable cutter bits which are not only able to intrude into and excavate hard natural ground in correspondence to a drive force, but also able to excavate soft natural ground with a high efficiency of operation.

Another object of the present invention is to provide a shield tunnelling machine capable of reducing the excavation force acting upon a pivot for swingably supporting the cutter bits.

A shield tunnelling machine according to the present invention includes a cylindrical shield body; a rotary cutter head disposed on the front end of the shield body and provided with a face plate having one or a plurality of slits extending in the radial direction; an intermediate support member for supporting a plurality of cutter bits respectively having forward bit portions and backward bit portions in each slit; means for supporting the intermediate support member swingably around an axis extending in the radial direction; a member for movably guiding the support means in the axial direction of the shield body; and means for moving the support means in the axial direction of the shield body to move the cutter bits toward and away from the front face of the face plate, the face plate and the guide member sharing the excavation force exerted on the cutter bits.

The support means is moved according to the hardness or softness of the natural ground to be excavated, thereby adjusting the length of each cutter bit projecting from the front face of the face plate. When the rotary cutter head is rotated while the shield body is moved, the cutter bits are swung through the intermediate support member which supports them, and the bit portions serving for the excavation intrude into the natural ground. The excavation force then exerted against the cutter bits is shared by the face plate and the member for movably guiding the support means to continue the excavating operation.

The swingable nature of the intermediate support member and the cutter bits permits the bit portions serving for the excavation to intrude into the natural ground as long as the cutter bits are pressed against the natural ground while the cutter head is rotated. Thus, even the hard natural ground may be excavated.

When the support means for supporting the intermediate support member is moved by the moving means, the cutter bits are moved toward or away from the front face of the face plate. Accordingly, if the natural ground to be excavated is of a hard nature, such hard natural ground is excavated efficiently by the power provided, by shortening the length of each cutter bit projecting from the front face of the face plate. Also, if the natural ground to be excavated is of a soft nature, such soft natural ground is excavated with improved efficiency by elongating the projecting length of each cutter bit. As a result, excavation is efficiently performed in accordance with the force applied, regardless of the nature of the hardness or solidity of the natural ground.

Since the face plate and the guide member share the excavation force generated on the cutter bits, the excavation force exerted on a pivot shaft that swingably supports the intermediate support member is sufficiently reduced. Thus, the occurrence of a defective swing due to bending of the pivot shaft is prevented.

When the excavation force exerted against the cutter bits is shared, the intermediate support member is preferably adapted to abut the face plate. This arrangement not only prevents the bending or deformation of the cutter bits resulting from abutting the cutter bits directly against the face plate, but also permits the establishment of a certain cutting angle for each cutter bit irrespective of the width of the slit and the dimension of the cutter bit or the like by changing the shape or the dimension of the intermediate support member. Then, as long as the face plate has a plurality of tips provided on both side edges of the slit and spaced at intervals in the radial direction so as to abut the intermediate support member, a particular cutting angle of the cutter bit is ensured by the tips, and an anti-wear measure is provided by the tips.

If a plurality of tips are provided on both side edges of the slit, the slit is preferably designed to be substantially closed by the cooperation of the intermediate support member and the tips whenever the cutter bits are moved rearward to the limit of their movement. Consequently, when the tunnelling machine is not operating, the earth pressure of the natural ground or the underground water pressure is resisted, and thereby prevents the natural ground from collapsing it.

As long as the intermediate support member and each tip are adapted to have respectively cofitting slanted surfaces and are positioned to confront each other, a rake angle of each cutter bit is made constant to obtain a fixed excavation effect, regardless of adjustments to the cutting height of each cutter bit, i.e., the length of each cutter bit projecting from the face plate. Also, since each tip receives the excavation force within the same plane, the stress concentrated at each tip is distributed, so that the tip may be made of a material having low strength.

Whenever the intermediate support member and each tip respectively have cofitting slanted surfaces, the support means is preferably provided with a pivot shaft for swingably supporting the intermediate support member. When the pivot shaft is located in front of a portion of the support means guided by the guide member, the intermediate support member is swung around the pivot shaft, and the slanted surface of the intermediate support member comes into contact with the slanted surface of each tip whenever the support means is moved.

If the intermediate support member and each tip respectively have slanted surfaces as described above and the support member is provided with the pivot shaft, the tips provided on both side edges of the slit are preferably symmetrical about an imaginary plane including an axis of the shield body and an axis of the pivot shaft, and the intermediate support member is preferably symmetrical about the imaginary plane whenever the intermediate support member is not swung. This configuration permits the same excavating effect to be achieved in both the forward and backward rotations.

When the cutter bits reach the rearward limit of the movement, the cutter bits are preferably adapted to be positioned rearward from the front face of the face plate. Since the cutter bits would not project from the face plate, the cutter head could be rotated with small resistance. Thereby, the adjustment of various apparatuses prior to the use of the tunnelling machine is facilitated.

As long as the support means is provided with a guidable planar portion and a guide member composed of two plates disposed at an interval corresponding to the thickness of the portion to be guided, the structure is simplified. In addition, the guide member may be made to have sufficient area to come into contact with the guidable portion of the support means, so that the guide member is likely to share the excavation force.

BRIEF DESCRIPTION OF THE DRAWINGS

The foregoing and other objects and features of the invention will become apparent from the following description of a preferred embodiment of the invention with reference to the accompanying drawings, in which.

DETAILED DESCRIPTION OF THE PREFERRED EMBODIMENT

Figure 1:
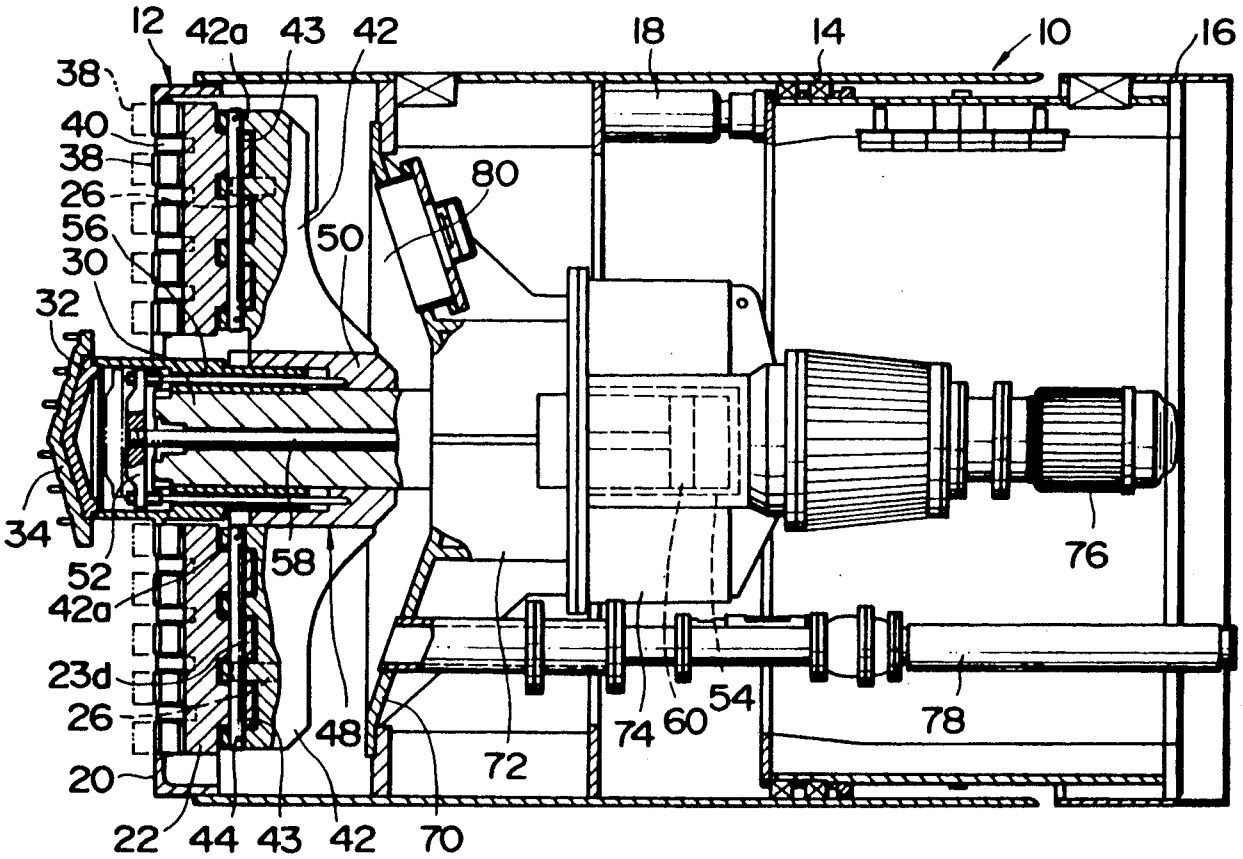
FIG. 1 is a sectional view showing a shield tunnelling machine according to the present invention.

A shield tunnelling machine comprises a cylindrical shield body 10 and a rotary cutter head 12, as shown in FIG. 1.

In the illustrated embodiment, shield body 10 is composed of a front tube 14 and a rear tube 16, and a plurality of direction correcting jacks 18 (one of them is shown in the drawing) are disposed between a flange of front tube 14 and a flange of rear tube 16. When direction correcting jacks 18 are expanded or contracted, front tube 14 oscillates relative to rear tube 16 to thereby correct the advance direction of shield body 10.

Figure 2:
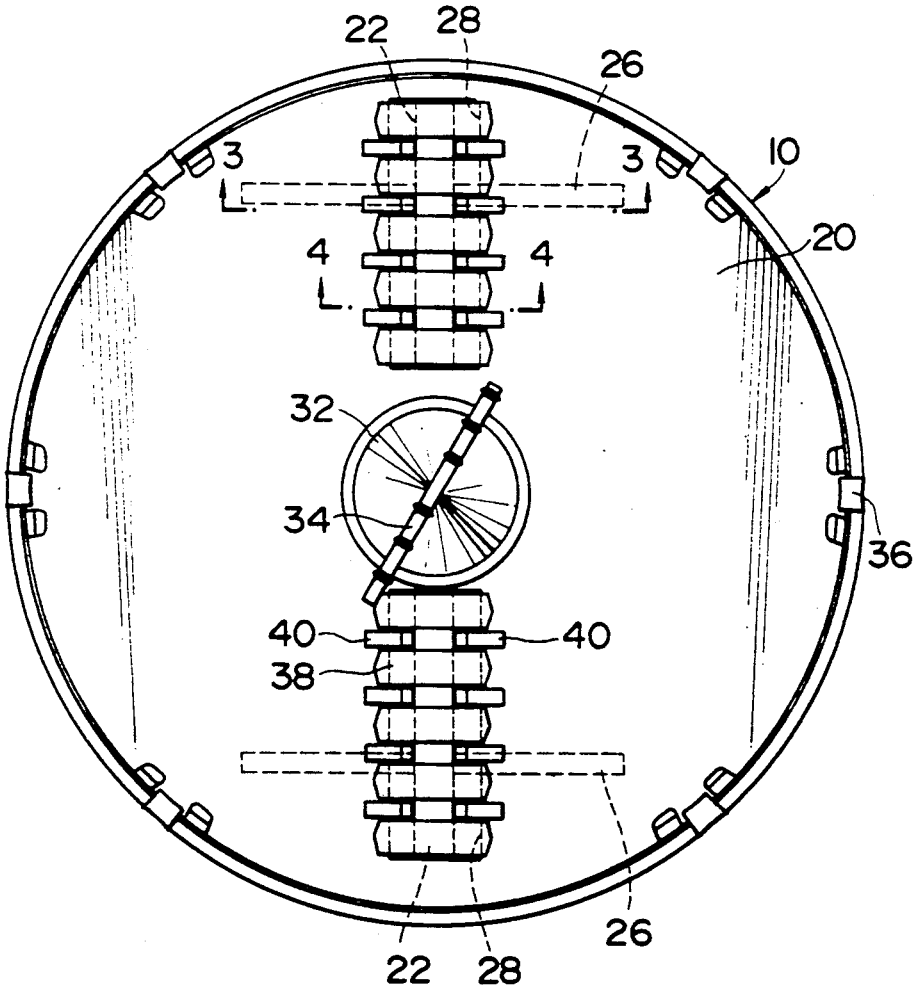
FIG. 2 is a front view showing a rotary cutter head.
Figure 3:
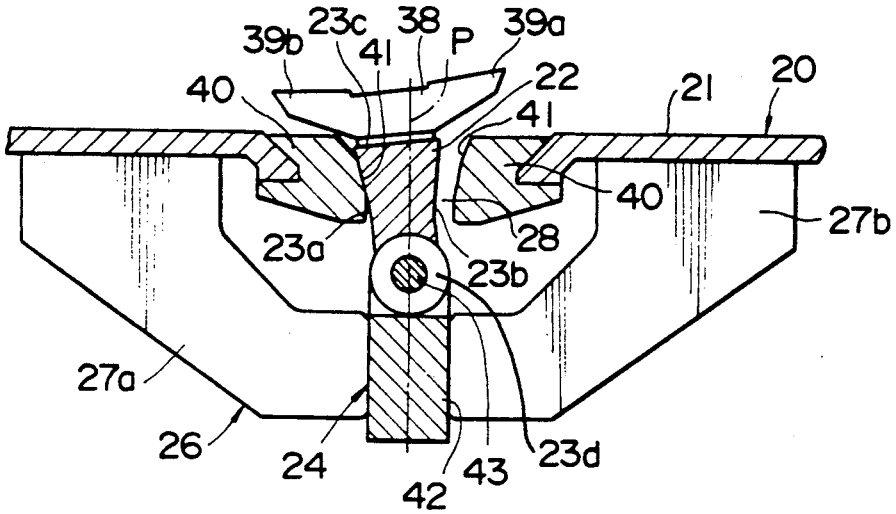
FIG. 3 is an enlarged-scale sectional view taken along a line 3—3 in FIG. 2 and showing a cutter bit, which is projected forward.

Rotary cutter head 12 is disposed on a front end of shield body 10 and provided with a face plate 20, an intermediate support member 22, support means 24, and a guide member 26, as shown in FIGS. 2 and 3 in detail.

Face plate 20 is of a circular planar shape and has one or a plurality of slits 28 (two slits in the illustrated embodiment) extending in the radial direction. Both slits 28 having rectangular planar shapes as shown in the drawing extend along the diameter of face plate 20. A rotary shaft 30 rotatably supported by shield body 10 and extending in the axial direction of shield body 10 extends through a central portion of face plate 20 to project forward from face plate 20. A projecting end of rotary shaft 30 is covered with a cap 32. Cap 32 has a center bit 34. A plurality of preceding bits 36 are provided on a peripheral edge of face plate 20 at intervals in the circumferential direction.

Intermediate support member 22 supports a plurality of cutter bits 38, so that each cutter bit 38 is disposed in a respective slit 28. In the illustrated embodiment, intermediate support member 22 is provided with two slant side faces 23*a* and 23*b*, and a flat front face 23*c*, and has a length substantially equal to the radial length of slit 28. Five cutter bits 38 and a plurality of bosses 23*d* are respectively mounted on front face 23*c* and to the rear face of intermediate support member 22 at uniform intervals in the length direction, i.e., in the radial direction of face plate 20. Each cutter bit 38 consists of a forward bit portion 39*a* and a backward bit portion 39*b*.

It is preferable that the intermediate support member 22 abuts face plate 20 directly or through a plurality of tips 40, thereby enhancing the ability of cutter bits 38 to share the excavation force with face plate 20 and guide member 26, as will later be described.

In the illustrated embodiment, tips 40 are respectively disposed on both side edges of slit 28 at uniform intervals in the radial direction. Tips 40 are mounted by means of welding or are press fit on an edge of face plate 20 defining slit 28 in such manner that tips 40 alternate with cutter bits 38. Each tip has a slant face 41 on a portion confronting intermediate support member 22. With respect to FIG. 3, slant face 41 of each tip 40 located at the left side and slant face 41 of each tip 40 located at the right side are respectively capable of abutting slant faces 23*a* and 23*b* of intermediate support member 22.

Support means 24 supports intermediate support member 22 swingably around an axis extending in the radial direction of face plate 20. In the illustrated embodiment, support means 24 has a guided planar member 42 and a pivot 43. Guided member 42 is provided with a plurality of bosses 42*a* that alternate with bosses 23*d* of intermediate support member 22 (see FIG. 1). Bosses 23*d* of intermediate support member 22 and bosses 42*a* of guided member 42 are arranged along a straight line. Pivot 43 extends through these bosses and is prevented from dropping out by a locking pin 44, so that intermediate support member 22 is swingably supported.

Figure 4:
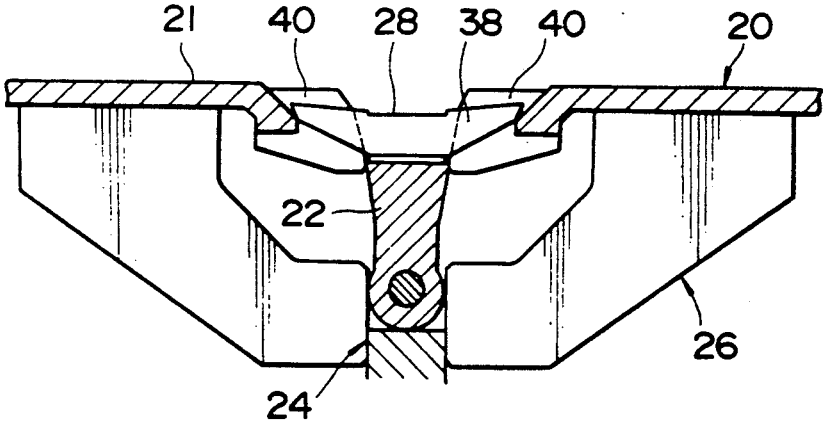
FIG. 4 is an enlarged-scale sectional view taken along a line 4—4 in FIG. 2 and showing the cutter bit, which is in the backward limit of its movement.

In the illustrated embodiment, tips 40 on both side edges of slit 28 are arranged symmetrically about an imaginary plane P (see FIG. 3) including the axis of shield body 10 and the axis of pivot 43. Intermediate support member 22 is formed symmetrically about the imaginary plane P when it is in its inoperative condition as shown in FIG. 4. Namely, slant face 41 of each tip 40 disposed at the left side of slit 28 is arranged in planar symmetrical relationship with slant face 41 of each tip 40 disposed at the right side, and slant faces 23*a* and 23*b* of intermediate support member 22 are also in planar symmetrical relationship with each other.

Guide member 26 movably guides support means 24 in the axial direction of shield body 10. In the illustrated embodiment, guide member 26 consists of two plates 27*a* and 27*b*. Plates 27*a* and 27*b* are arranged at an interval corresponding to the thickness of planar guided member 42 of support means 24 and welded to face plate 20. One guide member 26 is provided in each of slits 28 and located in the rear of pivot 43.

The excavation force exerted on each cutter bit 38 is shared by face plate 20 and guide member 26. Therefore, providing one guide member 26 made of plate material in each slit 28, as shown in FIG. 2, helps to distribute the excavation force exerted on cutter bits 38 during a tunnelling operation. Nevertheless, the reason that guide member 26 is provided in each slit 28 is because guided member 42 of support means 24 provided in correspondence to each slit is welded to a cylindrical slide member 50, which will be later described.

A means 48 is provided for moving support means 24 in the axial direction of shield body 10 to move cutter bits 38 toward and away from front face 21 of face plate 20. Moving means 48 includes slide member 50 mounted to rotary shaft 30 to be movable in the axial direction, a connecting member 52, and a cylinder device 54, as shown in FIG. 1.

Two guided members 42 are welded to slide member 50, and slide member 50 is connected to connecting member 52 through a connecting rod 56. Connecting member 52 is connected to an operating rod 58 that extends rearward through rotary shaft 30. Operating rod 58 is axially movable relative to rotary shaft 30, and a rear end of operating rod 58 extends rearward through rotary shaft 30. Operating rod 58 is axially movable relative to rotary shaft 30, and a rear end of operating rod 58 is connected to a piston 60 of cylinder device 54.

A bulkhead 70 within shield body 10 is spaced rearward from rotary cutter head 12, and has a bearing 72 mounted to its center. A reduction gear 74 disposed in the rear of bearing 72 is connected to two motors 76. Rotary shaft 30 extends through bearing 72 to reduction gear 74. One motor 76 is disposed on each side of reduction gear 74, and cylinder device 54 is mounted on the center of reduction gear 74. Thus, operating rod 58 extending from cylinder device 54 is inserted into rotary shaft 30 in reduction gear 74. A hydraulic pump (not shown) is connected to cylinder device 54.

Two pipes 78 for guiding muddy water (one of the pipes is shown in the drawing) are disposed laterally at an interval. These muddy water pipes are inserted and welded into openings provided in bulkhead 70. During operation of the tunnelling machine, muddy water is supplied from one muddy water pipe 78 into a liquid chamber 80 defined in front of bulkhead 70, and muddy water mixed with excavated earth and sand is discharged from the other muddy water pipe 78.

Also during operation of the tunnelling machine, pressurized oil is supplied to a push-side oil chamber (not shown) of cylinder device 54 of moving means 48 to move support means 24 in accordance with the hardness or softness of the natural ground to be excavated, and to adjust the length of cutter bits 38 projecting from front face 21 of face plate 20. When rotary cutter head 12 is rotated while shield body 10 is moved, each cutter bit 38 is swung through intermediate support member 22, and each bit portion 39*a*, for example, intrudes into the natural ground.

During excavation, one excavation force exerted against cutter bits 38 is shared by tips 40 provided on face plate 20, and another excavation force is shared by member 26 that movably guides support means 24 to continue the excavating operation. While the excavation force acts also on pivot 43, the excavation force exerted on pivot 43 is small, since support means 24 engages guide member 26 according to the present invention.

When excavation is completed, pressurized oil is supplied to a return-side oil chamber of cylinder device 54 of moving means 48 to move cutter bits 38 rearward to the limit of the movement. Thus, slit 28 is substantially closed by cooperation of cutter bits 38, intermediate support member 22, and tips 40, as shown in FIG. 4. Each cutter bit 38 is preferably sized such that it is located rearward from the front face 21 of face plate 20.

While a preferred embodiment of the present invention has been described and illustrated, various modifications will be apparent to those skilled in the art. The invention is intended to include all such modifications within the scope of the following claims.

We claim:

1. A shield tunnelling machine, comprising:

a cylindrical shield body;

a rotary cutter head disposed on a front end of said shield body and provided with a face plate having a plurality of slits extending in a radial direction of said shield body; an intermediate support member for supporting a plurality of cutter bits, each cutter bit having forward bit portions and backward bit portions, wherein one cutter bit is located in each slit; means for supporting said intermediate support member swingably around an axis extending in the radial direction; and a guide member for movably guiding said support means in an axial direction of said shield body; and means for moving said support means in the axial direction to move said cutter bits toward and away from a front face of said face plate;

said face plate and said guide member sharing an excavation force acting on said cutter bits.

2. A shield tunnelling machine according to claim 1, wherein said intermediate support member abuts said face plate whenever the excavation force acting on said cutter bits is shared.

3. A shield tunnelling machine according to claim 1, wherein said face plate is provided with a plurality of tips, against which said intermediate support member is abutted, located on both side edges of said slit at intervals in the radial direction.

4. A shield tunnelling machine according to claim 3, wherein said slit is substantially closed by said cutter bits, said intermediate support member, and said tips whenever said cutter bits are moved rearward to the limit of their movement.

5. A shield tunnelling machine according to claim 3, wherein said intermediate support member and each of said tips have respectively slanted cofitting faces on portions thereof confronting each other.

6. A shield tunnelling machine according to claim 5, wherein said support means has a pivot for swingably supporting said intermediate support member, said pivot being located in front of a portion of said support means guided by said guide member.

7. A shield tunnelling machine according to claim 6, wherein said tips provided on both side edges of said slit are disposed symmetrically about an imaginary plane including an axis of said shield body and an axis of said pivot, and said intermediate support member is formed symmetrically about said imaginary plane whenever said intermediate support member is in an inoperative condition.

8. A shield tunnelling machine according to claim 1, wherein said cutter bits are positioned rearward from the front face of said face plate whenever said cutter bits are moved rearward to the limit of their movement.

9. A shield tunnelling machine according to claim 1, wherein said support means is provided with a planar guided portion, and said guide member comprises two plates disposed at an interval corresponding to the thickness of said guided portion, said plates capable of guiding said guided portion.

* * * * *